US009541047B2

(12) United States Patent
Pohlmann et al.

(10) Patent No.: US 9,541,047 B2
(45) Date of Patent: Jan. 10, 2017

(54) SYSTEM HAVING A FUEL DISTRIBUTOR AND MULTIPLE FUEL INJECTORS

(71) Applicant: Robert Bosch GmbH, Stuttgart (DE)

(72) Inventors: Jens Pohlmann, Bietigheim-Bissingen (DE); Michael Fischer, Niefern-Oeschelbronn (DE); Martin Riemer, Untergruppenbach (DE); Markus Friedrich, Moosburg (DE); Andreas Rehwald, Bietigheim-Bissingen (DE); Michael Mayer, Wannwell (DE); Dietmar Uhlenbrock, Stuttgart (DE); Matthias Maess, Boeblingen (DE); Goekhan Guengoer, Eberdingen (DE); Venkatesh Kannan, Wixom, MI (US)

(73) Assignee: Robert Bosch GmbH, Stuttgart (DE)

( * ) Notice: Subject to any disclaimer, the term of this patent is extended or adjusted under 35 U.S.C. 154(b) by 61 days.

(21) Appl. No.: 14/400,818

(22) PCT Filed: Apr. 2, 2013

(86) PCT No.: PCT/EP2013/056862

§ 371 (c)(1),
(2) Date: Nov. 13, 2014

(87) PCT Pub. No.: WO2013/170998

PCT Pub. Date: Nov. 21, 2013

(65) Prior Publication Data

US 2015/0136086 A1 May 21, 2015

(30) Foreign Application Priority Data

May 14, 2012 (DE) ..... 10 2012 208 039

(51) Int. Cl.
*F02M 61/14* (2006.01)
*F02M 69/46* (2006.01)
(Continued)

(52) U.S. Cl.
CPC ..... *F02M 61/14* (2013.01); *F02M 41/00* (2013.01); *F02M 61/16* (2013.01);
(Continued)

(58) Field of Classification Search
CPC F02M 61/14; F02M 69/465; F02M 2200/853; F02M 2200/856; F02M 2200/9015
(Continued)

(56) References Cited

U.S. PATENT DOCUMENTS 5,005,878 A * 4/1991 Smith ..... F02M 55/004 285/319
5,035,224 A * 7/1991 Hornby ..... F02M 69/465 123/456
(Continued)

FOREIGN PATENT DOCUMENTS

| | | |
|---|---|---|
| EP | 2 034 171 | 3/2009 |
| EP | 2 072 800 | 6/2009 |
| EP | 2 151 572 | 2/2010 |

*Primary Examiner* — Erick Solis
(74) *Attorney, Agent, or Firm* — Norton Rose Fulbright US LLP; Gerard Messina

(57) ABSTRACT

A system, which is used in particular as a fuel injection system for the high-pressure injection in internal combustion engines, includes a fuel distributor and a plurality of fuel injectors. Each fuel injector is situated on a cup of the fuel distributor. At least one of the fuel injectors is fastened to the associated cup by a holding element, which has a supporting surface. The cup has a contact surface on an underside, by way of which the cup is supported at the supporting surface of the holding element by a damping layer. The holding element is attached to the cup. In addition, the fuel injector has a collar, which is braced on the holding element.
(Continued)

Because of the damping layer, vibrations are able to be dampened, and the noise transmissions is able to be reduced.

14 Claims, 2 Drawing Sheets

(51) Int. Cl.
*F02M 41/00* (2006.01)
*F02M 61/16* (2006.01)
*F02M 63/02* (2006.01)

(52) U.S. Cl.
CPC ..... *F02M 63/0275* (2013.01); *F02M 69/465* (2013.01); *F02M 2200/09* (2013.01); *F02M 2200/803* (2013.01); *F02M 2200/8023* (2013.01); *F02M 2200/853* (2013.01); *F02M 2200/855* (2013.01); *F02M 2200/856* (2013.01); *F02M 2200/9015* (2013.01)

(58) Field of Classification Search
USPC ..... 123/470
See application file for complete search history.

(56) References Cited

U.S. PATENT DOCUMENTS

| | | | | | |
|---|---|---|---|---|---|
| 5,074,269 | A * | 12/1991 | Herbon | F02M 55/004 | 123/456 |
| 5,167,213 | A * | 12/1992 | Bassler | F02M 61/145 | 123/456 |
| 5,301,647 | A | 4/1994 | Lorraine | | |
| 5,501,195 | A * | 3/1996 | Hall | F02M 61/145 | 123/470 |
| 6,481,420 | B1 * | 11/2002 | Panasuk | F02M 55/004 | 123/469 |
| 6,705,292 | B2 * | 3/2004 | Bugos | F02M 61/14 | 123/456 |
| 7,334,571 | B1 | 2/2008 | Beardmore | | |
| 7,802,559 | B2 * | 9/2010 | Furst | F02M 61/14 | 123/470 |
| 2007/0163545 | A1 * | 7/2007 | Beardmore | F02M 55/025 | 123/456 |
| 2010/0071664 | A1 * | 3/2010 | Hunt | F02M 55/025 | 123/456 |
| 2015/0345445 | A1 * | 12/2015 | Reinhardt | F02M 61/14 | 239/584 |

* cited by examiner

SYSTEM HAVING A FUEL DISTRIBUTOR AND MULTIPLE FUEL INJECTORS

FIELD OF THE INVENTION

The present invention relates to a system, especially a fuel injection system, for the high-pressure injection in internal combustion engines, having a fuel distributor and multiple fuel injectors. In particular, the present invention pertains to the field of fuel-injection systems for mixture-compressing internal combustion engine featuring external ignition, in which fuel is injected directly into the combustion chambers of the internal combustion engine.

BACKGROUND INFORMATION

A fuel distributor rail and multiple fuel injectors disposed on the fuel distributor rail are discussed in European patent EP 2 151 572 A2. A collar-shaped element having tabs on both sides, which is placed around an upper fuel nipple of the fuel injector, is provided to connect the fuel injectors to the fuel distributor rail. In addition, a retaining clip is provided, which engages around a cylindrical body of an injector connection of the fuel distributor rail from above, along a longitudinal axis, the tabs of the collar engaging with openings of the retaining clip. This fastens the fuel injector to the cylindrical body of the injector connection.

The design from the European patent 2 151 572 A2 has the disadvantage that, during operation, the fuel distributor rail can be excited to vibrations in the audible frequency range. This is due to noise sources in the fuel injectors, in particular. The structure-borne noise, for example, spreads from the fuel injectors, via the injector connections, the fuel distributor rail and the rail holders, in certain cases also to the add-on structure, from where interfering noise is radiated. These interfering noises may possibly even reach the interior of the vehicle.

SUMMARY OF THE INVENTION

The system according to the present invention having the features described herein has the advantage of ensuring improved vibrational damping. More specifically, it is advantageous that vibrations that arise in particular in the region of the fuel injectors are able to be effectively damped with regard to a transmission to the fuel distributor, so that interfering noise is reduced.

The measures set forth in the dependent claims enable advantageous developments of the system described herein.

The system is especially suitable for internal combustion engines featuring direct gasoline injection. The fuel distributor may be configured as a fuel distributor rail for this purpose. The fuel distributor stores fuel under high pressure and distributes the fuel among the plurality of fuel injectors, which are configured as high pressure fuel injectors, in particular. The fuel required for the combustion process is then injected by the fuel injectors into the respective combustion chamber of the internal combustion engine under high pressure. The fuel is compressed by a high-pressure pump and conveyed in controlled quantities into the fuel distributor via a high-pressure line.

The system may advantageously be configured as a fuel-injection system for the high-pressure injection in internal combustion engines, and the fuel distributor may be connected to an add-on structure in a suitable manner. The add-on structure may be the cylinder head of the internal combustion engine. A connection via spacer sleeves or via additional connection elements is possible as well.

The fuel injectors may be suspended on the cups, so to speak. Especially a gimbal-type mounting on the cups is possible. The holding element may be developed as a U-shaped clip, in particular. The holding element transmits the quasi-static forces. At the same time, the holding element assumes the function of ensuring that the relative deflection of a fuel injector in relation to the associated cup under the effect of operating forces remains under a defined limit value, so that an O-ring seal is protected from wear.

In addition, a vibration-related decoupling and damping between the fuel injectors and the fuel distributor is achieved by the one or multiple damping layer(s), while the other requirements continue to be satisfied.

It is advantageous that the collar of the fuel injector is at least indirectly braced on the supporting surface of the holding element. This includes the possibility that the collar of the fuel injector is braced directly on the supporting surface of the holding element. However, it is especially advantageous that the collar of the fuel injector is braced on the holding element by way of the damping layer, which further improves the oscillation decoupling. More specifically, the collar of the fuel injector may be braced on the supporting surface of the holding element by way of the damping layer. The supporting surface of the holding element may thus ensure the bracing both of the cup and the collar of the fuel injector.

It is advantageous that the holding element has at least one holding section, the cup has a collar, and the holding section of the holding element clasps the collar of the cup from behind. In this context it is furthermore advantageous that the holding section is configured as a U-shaped bent holding section. This results in a compact design of the holding element. The holding element is thereby able to be configured as a retaining clip, in particular. The holding section of the holding element may rest directly against the collar of the cup. However, it is especially advantageous that the holding section of the holding element is braced on the collar of the cup by an additional damping layer. This further improves the damping of vibrations. However, it is also especially advantageous that the damping layer provided at the supporting surface also extends along the inside of the holding section of the holding element and that the holding section of the holding element is braced on the collar of the cup by the damping layer. The damping layer may thus act on both sides of the collar of the cup, so to speak.

In an advantageous manner, the damping layer or the further damping layer is based on a visco-elastic material. The damping layer or the further damping layer can advantageously be connected to the holding element. The connection may be configured using vulcanization, for instance. The visco-elastic material for the damping layer is able to be based on rubber, in particular. The term rubber should be taken quite generally in this case, and besides natural rubber also includes synthetic rubber materials.

It is also advantageous that the damping layer or the further damping layer is configured as a separate insertion part. This also ensures a modular development in which, depending on the individual case, a suitable damping layer or a further damping layer is combined with an appropriately configured holding element.

Exemplary embodiments of the present invention are explained in greater detail in the following description with reference to the attached drawing, in which corresponding elements have been provided with matching reference numerals.

DETAILED DESCRIPTION

Figure 1:
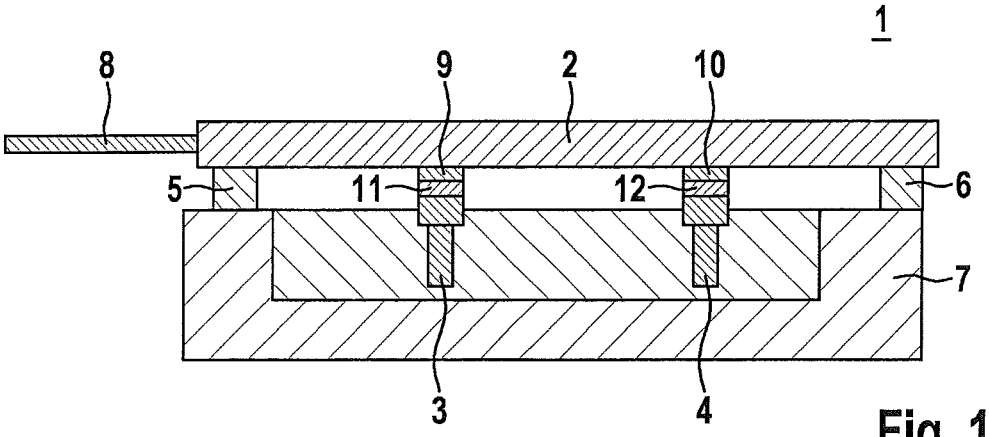
FIG. 1 shows a system having a fuel distributor and a plurality of fuel injectors in a schematic sectional representation corresponding to a first exemplary embodiment of the present invention.

FIG. 1 shows a system 1 having a fuel distributor 2 and a plurality of fuel injectors 3, 4, in a schematic sectional representation which corresponds to a first exemplary embodiment. In particular, system 1 may be configured as a fuel-injection system for the high-pressure injection in internal combustion engines. Fuel distributor 2 is able to be fastened to an add-on structure 7, particularly to a cylinder head 7, at specified screw-on points via holders 5, 6 or similar devices. To simplify the illustration, only two fuel injectors 3, 4 are shown in FIG. 1. A larger number of fuel injectors may also be provided, however. In this exemplary embodiment, fuel distributor 2 is configured as a fuel distributor rail 2, having an elongated tube-shaped base body. A high-pressure line 8 which is connected to fuel distributor 2 is provided. During an operation, highly pressurized fuel is supplied into fuel distributor 2 via high-pressure line 8.

Fuel distributor 2 has a plurality of cups 9, 10. Fuel injector 3 is disposed on cup 9, and fuel injector 4 is disposed on cup 10. Damping layers 11, 12 are provided in addition. Damping layer 11 acts between fuel injector 3 and cup 9, and damping layer 12 acts between fuel injector 4 and cup 10. FIG. 1 shows the force transfer path from fuel injector 3 or fuel injector 4 and fuel distributor 2, in which path damping layer 11 or damping layer 12 is situated. The structural design and the connection of fuel injector 3 to fuel distributor 2 according to the first exemplary embodiment will be described in greater detail below, with the aid of FIG. 2. The connection between fuel injector 4 and fuel distributor 2 is configured analogously.

Figure 2:
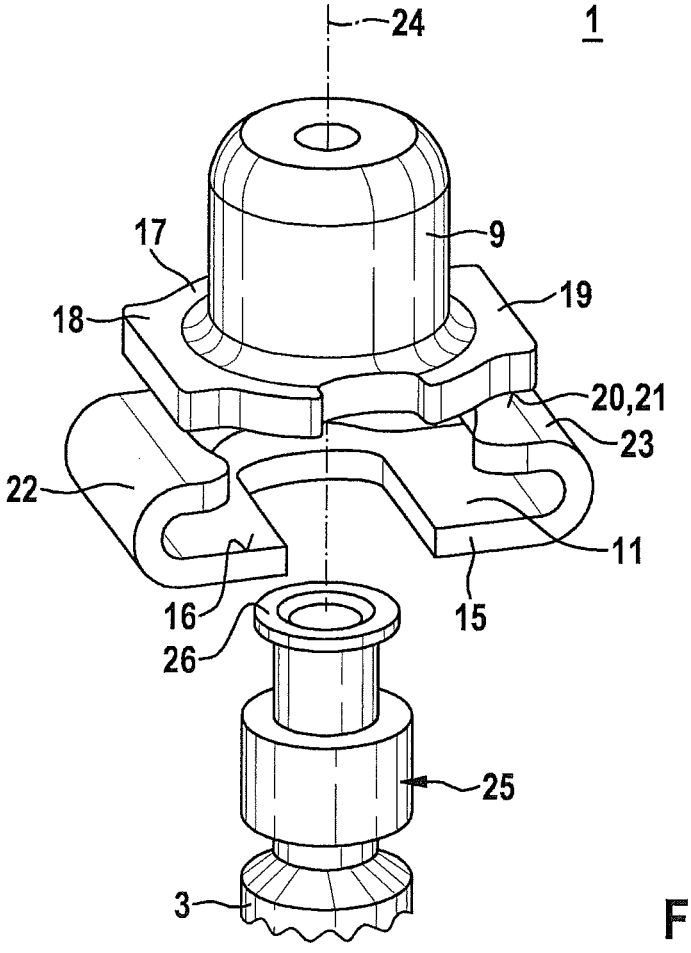
FIG. 2 shows an excerpted schematic exploded view of the system shown in FIG. 1, corresponding to the first exemplary embodiment of the present invention.

FIG. 2 shows an excerpted schematic exploded view of the system of the first exemplary embodiment shown in FIG. 1. System 1 has a holding element 15, which connects fuel injector 3 to cup 9 of fuel distributor 2. Holding element 15 is configured as a retaining clip 15. Holding element 15 has a supporting surface 16, on which damping layer 11 is disposed. In addition, cup 9 has a collar 17 provided with shaped tabs 18, 19. In addition, a contact surface 21 is provided at an underside 20 of cup 9. In this exemplary embodiment, contact surface 21 is formed by underside 20 of cup 9. Other types of designs are possible as well, however. For example, underside 20 is not necessarily planar, and contact surface 21 may in part be formed by underside 20 of cup 9.

Holding element 15 has holding sections 22, 23, which are configured as U-shaped holding sections 22, 23 in this exemplary embodiment.

When assembled, collar 17 is inserted in holding element 15. In the assembled state, holding section 22 grips tab 18 of collar 17 from behind. In addition, holding section 22 grips tab 19 of collar 17 from behind in the installed state. This produces a keyed connection between cup 9 and holding element 15 along a longitudinal axis 24. Damping layer 11 is situated between contact surface 21 of cup 9 and supporting surface 16 of holding element 15.

Fuel injector 3 includes a collar 25, which may be formed by a connection sleeve 25. In the assembled state, collar 25 of fuel injector 3 is braced on supporting surface 16 of holding element 15 by damping layer 11. A fuel nipple 26 of fuel injector 3 is then situated within cup 9. A sealing ring 27 (FIG. 3) may be provided between fuel nipple 26 and collar 25. Sealing ring 27 cooperates with cup 9 to form a seal. This allows the supply of the fuel under high pressure from fuel distributor 2 via fuel nipple 26 into fuel injector 3.

The presence of damping layer 11 enables an acoustic decoupling. Damping layer 11 may be produced from a visco-elastic material that allows a decoupling or an isolation of the noise sources produced at fuel injector 3 with respect to fuel distributor 2. In addition, fewer structure-borne noise components are transmitted from fuel distributor 2 to the add-on structure, especially cylinder head 7. As a result of these two effects, the sound radiation and the sound transmission from system 1 to the engine are reduced.

The mechanical operating principle for reducing vibrations with the aid of damping layer 11 and, correspondingly, damping layer 12 may be described as follows: While under an operational load, damping layer 11 is dynamically stressed to a high degree, and a high portion of vibrational energy is thereby dissipated by material damping of the elastomer. The dissipation of structure-borne noise always leads to damping of oscillation forms of fuel injector 3 and fuel distributor 2. As a consequence, a reduction in all structure-borne noise components that are transmitted by damping layer 11 from fuel injector 3 into fuel distributor 2 comes about. This characteristic corresponds to a decoupling, or rather an insulation, between fuel injector 3 and fuel distributor 2. Pure metal contacts, via which a transmission of structure-borne noise would efficiently be possible, are reduced or even prevented entirely. In particular, a design is possible in which the contacts are established only via plastic components.

The properties of damping layer 11, such as the thickness or form, an area proportion or material-specific properties may be adapted with regard to some optimization parameters. Optimization parameters above all are frequency contents to be damped, and the temperature.

This applies analogously to damping layer 12 and, as the case may be, additional damping layers that allow damping between fuel injectors 3, 4 and fuel distributor 2.

The development described on the basis of FIG. 2 may be used in each fuel injector 3, 4 of system 1.

Holding element 15 may be produced from formed sheet metal, for example. In this case, damping layer 11 is able to be configured as a separate insertion part 11 and rest against supporting surface 16 of holding element 15. Damping layer 11 may be very thin in this case. Conceivable is also a development in which damping layer 11 is connected to supporting surface 16 of holding element 15. Especially a connection with the aid of vulcanization is possible in this context. Damping layer 11 is produced from a rubber material in such a case. The term rubber should be taken quite generally in this case, and besides natural rubber also includes synthetic rubber materials.

In the first exemplary embodiment described with the aid of FIG. 2, damping layer 11 acts as one-sided damping layer 11, so to speak, which is situated on one side of collar 17 of cup 9.

Figure 3:
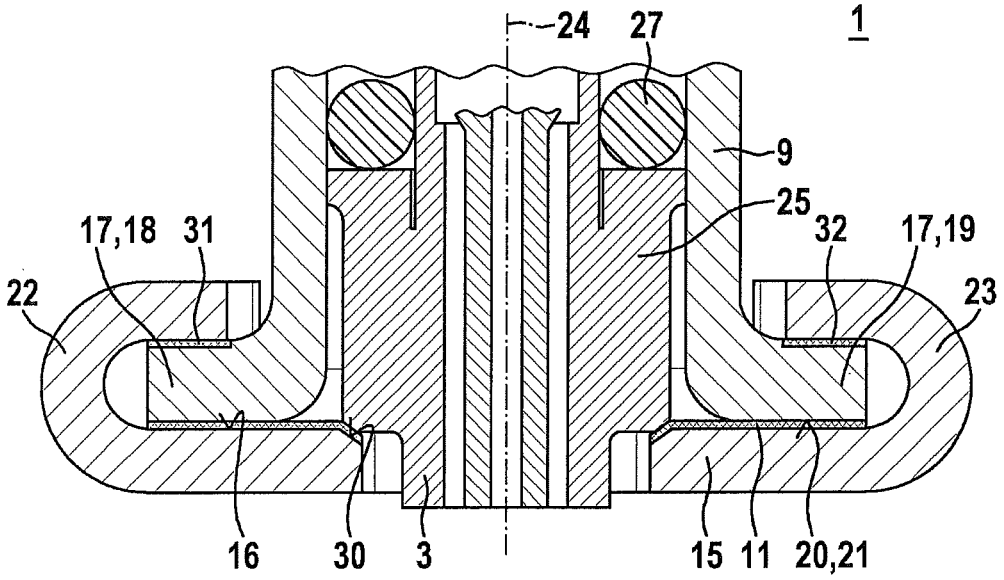
FIG. 3 shows an excerpted schematic axial section through the system shown in FIG. 2, corresponding to a second exemplary embodiment of the present invention.

FIG. 3 shows, in excerpted form, a schematic axial section of system 1 shown in FIG. 2, according to a second exemplary embodiment. In this exemplary embodiment, holding element 15 has a conical contact surface 30, which may be formed by a chamfer 30, for instance. Damping layer 11 also extends across conical contact surface 30 of holding element 15. Via its collar 25, fuel injector 3 is braced on conical contact surface 30 with the aid of damping layer 11.

In addition, another damping layer 31 is provided, which is situated between holding section 22 and tab 18 of collar 17. By way of additional damping layer 31, holding section 22 of holding element 15 is braced on collar 17 of cup 9. In a corresponding manner, another damping layer 32 is disposed also between holding section 23 and tab 19 of collar 17. Holding section 23 therefore supports itself on collar 17 of cup 9 by additional damping layer 32 as well. Damping layers 11, 31, 32 are thus provided on both sides of collar 17, so to speak. Damping layers 11, 31, 32 allow an especially advantageous damping of the vibrations that may be transmitted via the mechanical connection between fuel injector 3 and fuel distributor 2. Additional damping layers 31, 32 may be similar to damping layer 11 in their design. A development made of different materials may also be used for this purpose.

Figure 4:
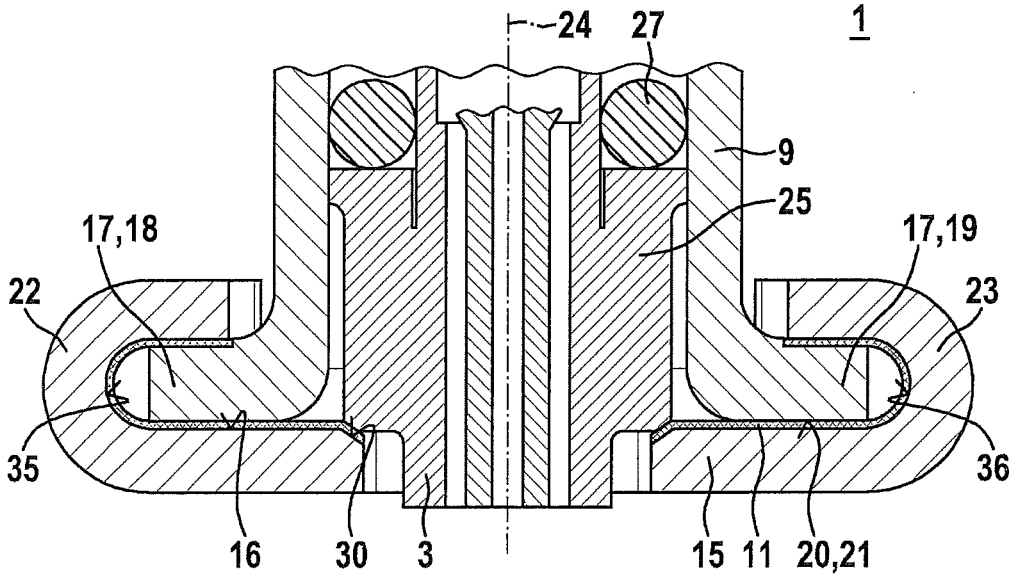
FIG. 4 shows an excerpted schematic axial section through the system shown in FIG. 2, corresponding to a third exemplary embodiment of the present invention.

FIG. 4 shows, in excerpted form, a schematic axial section of system 1 shown in FIG. 2, which corresponds to a third exemplary embodiment. In this exemplary embodiment, damping layer 11 provided on supporting surface 16 of holding element 15 also extends along an inner side 35 of holding section 22, and along an inner side 36 of holding section 23. Holding section 22 is thereby supported on tab 18 of collar 17 via damping layer 11. In addition, holding section 23 is supported on tab 19 of collar 17 via damping layer 11. A single damping layer 11, which is configured as a continuous damping layer 11, is therefore able to be used to achieve bilateral damping between collar 17 and holding element 15.

In the exemplary embodiments described with the aid of FIG. 1 through 4, damping layers 11, 12, 31, 32 may each be configured as separate insertion parts. One or more damping layer(s) 11, 12, 31, 32 can also be connected to the particular holding element 15, in which case an in particular integral connection through vulcanization is possible. Additional damping layers 31, 32 may be configured as mutually separate damping layers 31, 32. However, a development in which a further damping layer 31, 32 assumes the function of the two damping layers 31, 32 is possible as well. Further damping layer 31, 32, for example, may have a U-shaped design. In a similar manner, damping layer 11 may also have a U-shape, as illustrated in FIG. 2.

Depending on the development, several advantages are therefore able to be derived from one or more damping layer(s) 11, 31, 32. Because of the decoupling, the transmission of structure-borne noise into fuel distributor 2, and thus into the add-on structure, especially cylinder head 7, is able to be improved while the requirements with regard to function and robustness are satisfied at the same time. Noise emissions from fuel distributor 2 are reduced as a result.

Despite damping layers 11, 31, 32, a relatively stiff connection of fuel injector 3 to fuel distributor 2 is able to be ensured. The flexibility of fuel injector 3, and similarly of fuel injector 4, increases only slightly and satisfies all of the functional requirements, e.g., low relative movement of fuel injectors 3, 4, and the strength requirements, especially with regard to wear of sealing ring 27. Acoustical, functional and strength requirements resulting from the design of fuel injectors 3, 4 and fuel distributor 2 may therefore be satisfied at the same time.

One potential development of holding element 15, which is made from reformed sheet metal, makes it possible to adapt radii and contours with regard to associated cup 9 and fuel injector 3 in order to avoid line contacts.

On account of the gimbal-type bearing arrangement of fuel injectors 3, 4, the full tolerance adjustment can be retained.

Since damping layers 11, 31, 32 are situated within holding element 15, so to speak, they are advantageously protected from the environment. Vulcanization may be used for an especially satisfactory protection from abrasion.

Moreover, the installation expense is kept low because of the low number of components. In addition, a compact design results as well, in which damping layers 11, 31, 32 do not require a lot of installation space.

Moreover, the decoupling may be used in a line-bound design of fuel injector 2, in that damping layers 11, 31, 32, which serve as decoupling elements, are used at the joint between suspended fuel injector 3 and the function block, i.e., fuel distributor 2.

The present invention is not restricted to the exemplary embodiments described.

What is claimed is:

1. A system, comprising:

a fuel distributor; and a plurality of fuel injectors, each of the fuel injectors being situated on a cup of the fuel distributor, and at least one of the fuel injectors being fastened to the associated cup by a holding element, wherein the holding element has a supporting surface, wherein the cup has a contact surface at an underside of the cup, via which the cup is supported at the supporting surface of the holding element by at least one damping layer, and wherein the holding element is secured on the cup, and the fuel injector has a collar which is at least indirectly supported on the holding element.

2. The system of claim 1, wherein at least one of the following is satisfied:

(i) the collar of the fuel injector is at least indirectly supported at the supporting surface of the holding element, (ii) the collar of the fuel injector is supported on the holding element by the damping layer, and (iii) the collar of the fuel injector is supported on the supporting surface of the holding element by the damping layer.

3. The system of claim 1, wherein the holding element has at least one holding section, the cup has a collar, and the holding section of the holding element clasps the collar of the cup from behind.

4. The system of claim 3, wherein the holding section is configured as a holding section bent in a U-shape.

5. The system of claim 3, wherein the holding section of the holding element rests directly against the collar of the cup.

6. The system of claim 3, wherein the holding section of the holding element rests against the collar of the cup by at least one further damping layer.

7. The system of claim 3, wherein the damping layer at the supporting surface also extends along an inner side of the holding section of the holding element and the holding section of the holding element is supported on the collar of the cup by the damping layer.

8. The system of claim 1, wherein the damping layer is based on a visco-elastic material.

9. The system of claim 1, wherein the damping layer is connected to the holding element.

10. The system of claim 1, wherein the damping layer is configured as a separate insertion part.

11. The system of claim 1, wherein the holding element includes at least one U-shaped holding section, the cup has a collar which is positioned within the U-shaped holding section, and the damping layer extends along an inside of the U-shaped holding section so that the damping layer is in contact with the collar of the cup on at least two sides of the collar of the cup.

12. The system of claim 11, wherein the collar of the fuel injector is in contact with the damping layer.

13. The system of claim 1, wherein the holding element includes at least one U-shaped holding section, the cup has a collar which is positioned with the U-shaped holding section, the damping layer is in connect with the collar on a first side of the collar of the cup, and a further damping layer is in contact with the collar on a second side of the collar of the cup.

14. The system of claim 13, wherein the collar of the fuel injector is in contact with the damping layer.

* * * * *